US006447646B1

(12) United States Patent
Hassinen et al.

(10) Patent No.: US 6,447,646 B1
(45) Date of Patent: Sep. 10, 2002

(54) DOCTOR ASSEMBLY IN A PAPER MACHINE WITH A JOINTED BEARING

(75) Inventors: Reijo Hassinen, Leppävesi; Samppa J. Salminen, Jyväskylä, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/890,342

(22) PCT Filed: Feb. 1, 2000

(86) PCT No.: PCT/FI00/00064

§ 371 (c)(1),
(2), (4) Date: Jul. 26, 2001

(87) PCT Pub. No.: WO00/46445

PCT Pub. Date: Aug. 10, 2000

(30) Foreign Application Priority Data

Feb. 3, 1999 (FI) ..... 990196

(51) Int. Cl.[7] ..... D21G 3/00

(52) U.S. Cl. ..... 162/281; 15/256.51; 15/256.53; 101/169; 118/261

(58) Field of Search ..... 162/281, 352; 101/169; 15/256.51, 256.53; 34/120; 118/652, 261, 126

(56) References Cited

U.S. PATENT DOCUMENTS

| | | | | |
|---|---|---|---|---|
| 3,748,686 | A | 7/1973 | Winterburn et al. | 15/256.51 |
| 3,803,665 | A | 4/1974 | Winterburn et al. | 15/256.51 |
| 4,906,335 | A | 3/1990 | Goodnow et al. | 162/281 |
| 4,953,252 | A | 9/1990 | Akizawa | 15/308 |

FOREIGN PATENT DOCUMENTS

| | | |
|---|---|---|
| WO | 9519310 | 7/1995 |

*Primary Examiner*—Dean T. Nguyen
(74) *Attorney, Agent, or Firm*—Fildes & Outland, P.C.

(57) ABSTRACT

The invention relates to a doctor assembly in a paper machine, which is intended to clean, e.g., a roll, and which includes a surface against which a doctor blade is set, a blade support for supporting the doctor blade, a frame, a jointed bearing assembly, which supports the doctor blade and is itself supported from the frame, and which is parallel to the doctor blade, and extends essentially over the entire width of the roll, and loading devices between the blade support and the frame for turning the doctor blade in relation to the frame and for pressing the doctor blade against the surface with a selected pressure. Due to the continuous support, there is essentially no deflection in the doctor assembly, when it is attached by its frame directly to the structures of the paper machine.

11 Claims, 3 Drawing Sheets

DOCTOR ASSEMBLY IN A PAPER MACHINE WITH A JOINTED BEARING

THECNICAL FIELD

The present invention relates to a doctor assembly in a paper machine, which is intended to clean a moving surface, such as a roll, felt, or wire. The doctor assembly includes

- a doctor blade set against the moving surface
- a blade carrier for supporting the doctor blade
- a frame
- a jointed bearing assembly supporting the blade carrier, and itself supported from the frame component, and parallel to the doctor blade, and
- loading devices between the blade carrier and the frame, for rotating the doctor blade in relation to the frame and for pressing the doctor blade against the surface with a selected force;

and in which the jointed bearing assembly between the blade carrier and the frame comprises an operational joint sleeve fixed in one of these components and an operational joint pin fixed in the opposing component, the joint pin being installed to be able to rotate in the joint sleeve.

BACKGROUND OF THE INVENTION

Here, a paper machine refers broadly to all similar machines, particularly also to board machines. In these machines, a doctor assembly is used to keep the rolls clean. The doctor blade of the doctor assembly cleans fibre residue and water from the surface of the roll and, in case of a web break, guides the web in the desired direction. Doctor assemblies are also used in connection with other moving surfaces, such as felts and wires, in addition to rolls.

SUMMARY OF THE INVENTION

A doctor assembly is usually built on a doctor beam, which is set in bearings so that it can be rotated and moved slightly axially, so that it can be moved backwards and forwards with the aid of an oscillating device. The rotatable doctor beam may also have two or more doctors attached to it, each with its own adjustable blade holder. If the doctor beam can be turned, it is used to set the doctor blade in either a maintenance or an operating position. An adjustment device forming part of the doctor assembly is then used to set each doctor blade against the surface with a selected pressure. The doctor assembly includes a holder frame, a jointed bearing assembly, and loading devices, which are generally placed on both sides of the cross-section of the joint.

The doctor blade, blade holder, and holder frame extend unbroken over the entire width of the paper machine. Similarly, the frame and the hoses used as loading devices extend unbroken over the entire width of the paper machine. A jointed bearing assembly, on the other hand, is often only implemented at the ends of the holder frame, in which case the deflection of the latter becomes a problem. U.S. Pat. No. 4,906,335 discloses a doctor assembly, in which the blade holder is supported by several joint members set at intervals. Such assemblies are not, however, in use. Due to the construction of the doctor assembly, the replacement of the doctor blade, or maintenance in general has required the doctor assembly to be turned to a special maintenance position, which is implemented by means of a rotating doctor beam construction. Oscillation has also been connected to this doctor beam.

Known doctor assemblies are extremely heavy, because the doctor beam must be made robust, so that it will turn the blade holder sufficiently also in the centre of the beam, despite deflection. Similarly, the holder frame carrying the doctor blade has generally had to be made quite sturdy, to allow for the great distance between the jointed bearing assemblies.

The present invention is intended to create an entirely new kind of doctor assembly, which is considerably lighter and easier to operate than previous doctor assemblies.

A doctor assembly in a paper machine, which is intended to clean a moving surface, such as a roll, a felt or a wire, and which includes a surface against which a doctor blade is set, a blade support for supporting the doctor blade, a frame, a jointed bearing assembly, which supports the doctor blade and is itself supported from the frame, and which is parallel to the doctor blade, and loading devices between the blade support and the frame for turning the doctor blade in relation to the frame and for pressing the doctor blade against the surface with a selected pressure; and in which the jointed bearing assembly between the blade support and the frame consists or a joint sleeve fixed to one of these components and an operational joint pin fixed to the opposing component and the joint pin is installed to rotate in joint sleeve, characterized in that the jointed bearing assembly extends essentially over the entire width of the doctor blade, either continuously or discontinuously. Because the doctor assembly is supported essentially over its entire width, it no longer need be dimensioned on the basis of deflection. A doctor beam is no longer required, as the doctor assembly is attached directly to the doctor frame. The continuous support is preferably implemented by means of a continuous joint, so that the blade holder can be simply pulled along the joint to replace the blade or for maintenance. According to one preferred embodiment, the joint sleeve is set in the bottom of a structure with a U-shaped cross-section. Both the joint and the loading members are then protected against dirtying. According to another preferred embodiment, a heavy doctor beam with its rotating devices is no longer required at all, as the doctor blade with the blade holder can be pulled out along the longitudinal jointed bearing assembly. Other embodiments and advantages of the invention will become apparent in connection with the following examples of embodiments.

In the following the invention is described with reference to the accompanying figures, in which

DETAILED DESCRIPTION OF THE INVENTION

Figure 1:
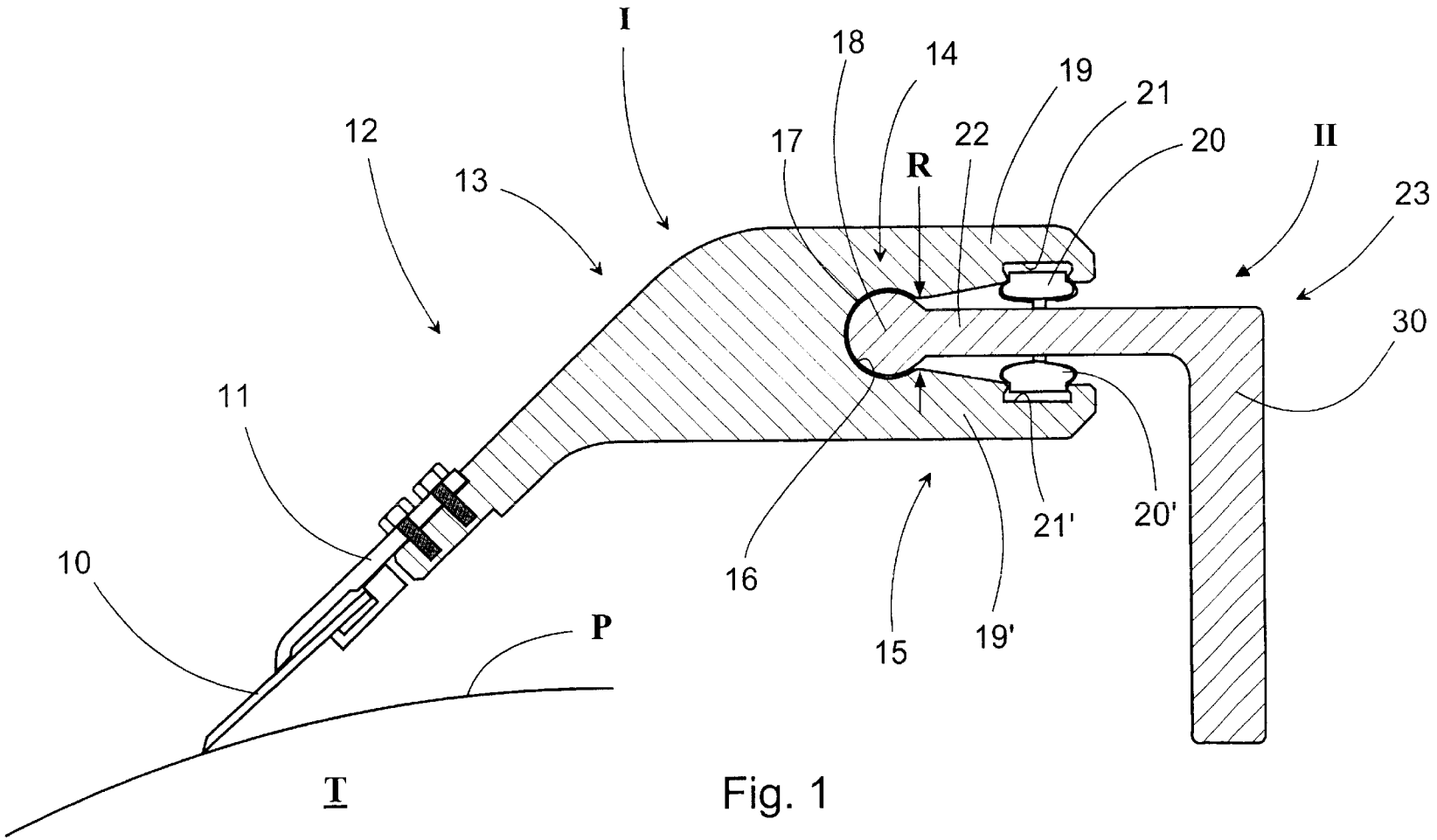
FIG. 1 shows a cross-section of one doctor assembly according to the invention.

In FIG. 1, a doctor assembly according to the invention is installed in connection with roll T. The doctor blade 10 scrapes the surface P of roll T. Doctor blade 10 is attached to blade holder 11, which is in turn attached to holder frame 13, which includes a U-shaped structure 15. Joint sleeve 16 is formed in the bottom of this U-shaped structure. The parts supporting doctor blade 10 related to this joint 16 are referred to in general as blade support 12. The other component, joint pin 17, of jointed bearing assembly 14 is formed into a unified axle 18 at the end of the thin flange area 22 of frame 23. In this case, the thin flange area is part of frame 23, which in turn also forms a bearer 30 for attaching the doctor assembly to the frame structures of the paper machine.

Here doctor blade 10 and blade holder 11 are, in a known manner, essentially the same width of the roll. On the other hand, an entirely new feature is that jointed bearing assembly 14 also extends over the entire width of the roll. Generally, jointed bearing assembly 14 always extends over the essential part of the width of doctor blade 10, either continuously or discontinuously. The thin flange area 22 extends to joint pin 17, through gap R. The axle 18 formed by joint pin 17 can rotate to a limited extent within the limits permitted by gap R and the claws 19 and 19' of the U-shaped structure 15.

In this case, loading devices 20, 20' are arranged in an area protected from dirtying on each side of thin flange area 22, between claw 19/19' and thin flange area 22. Here, the loading hoses normally used in doctors and coating machines are used as the loading devices. These are installed in grooves 21 and 21' made in claws 19 and 19' of the U-shaped structure 15.

The oscillating device is preferably attached to holder frame 13, so that the oscillating movement takes place in jointed bearing assembly 14. The oscillating mass is a fraction of that in known constructions.

Because the bearing surfaces of jointed bearing assembly 14 are distributed over the entire width of the roll, the loading pressure remains quite low. In this case, it is possible to consider jointed bearing assembly components, which in this case are formed by extruded or pultruded pieces, generally marked with the reference numbers I and II. In installation, blade holder 11 with blade 10 is attached to the holder frame 13 and loading hoses 20 and 20' are set in their grooves 21 and 21'. Next, this totality is pushed axially onto frame 23, so that joint sleeve 17 slides over joint pin 16 and loading hoses 20 slide along both sides of thin flange area 22 of frame 23. Next, the oscillating device is connected and the pressure medium connections are connected to the loading hoses.

The doctor assembly created is quite simple and light. The jointed bearing assembly is in a fully protected space, isolated by the loading devices, which themselves are in a well protected space, especially if the jointed bearing assembly is continuous over its entire length. The loading pressures on the jointed bearing assembly remain, as stated above, fairly low, so that there may be no necessity for the separate machining of the bearing surfaces.

In principle, the construction according to FIG. 1, can be turned around, so that piece I containing the joint sleeve is in frame component 23 and correspondingly blade support 13' contains joint 17, thus forming piece II. The loading devices and the joint can then be easily protected by separate guards 25, which can be formed from a protective fabric or a sheet of rubber, FIG. 2.

Figure 2:
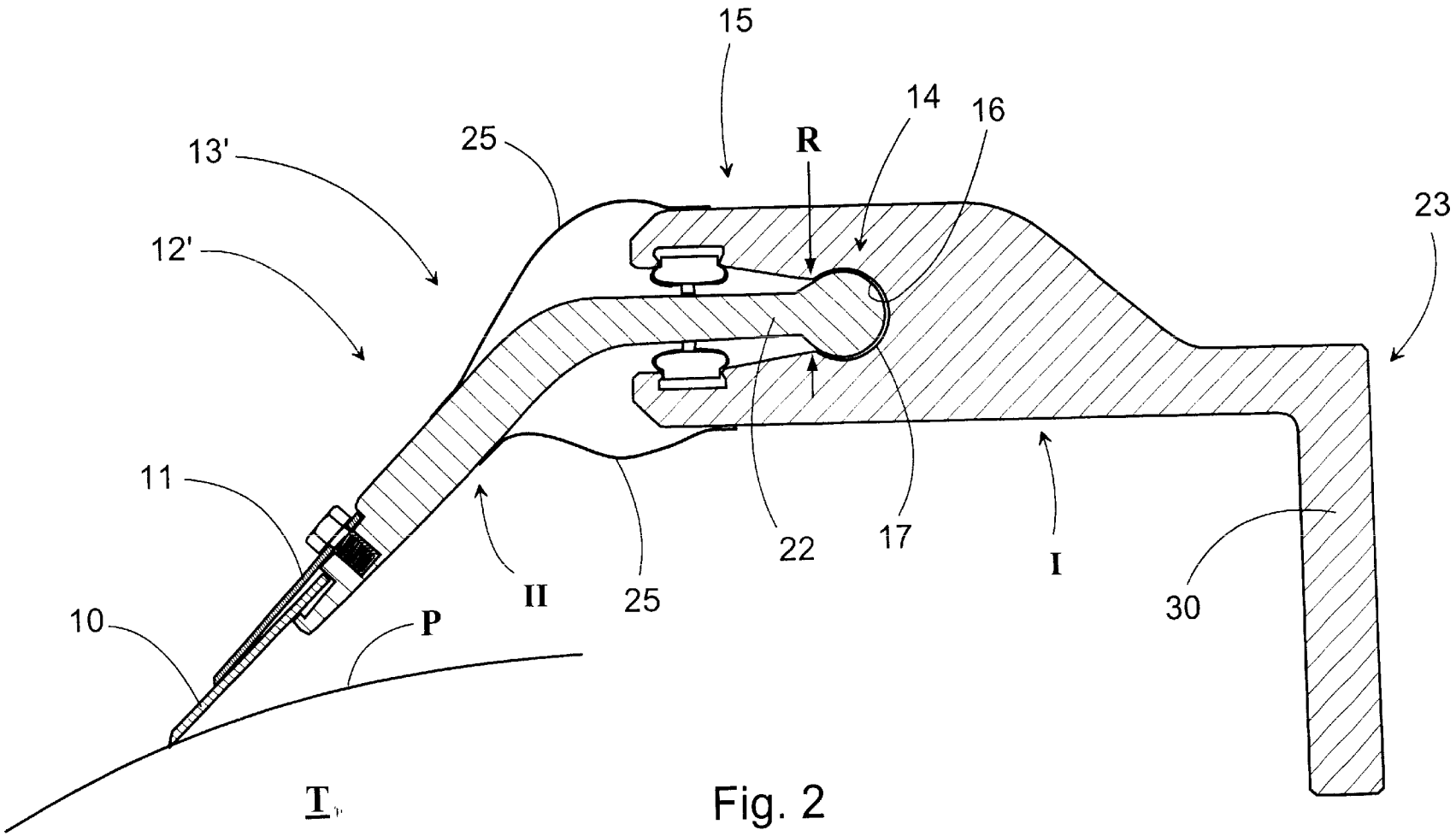
FIG. 2 shows another embodiment of a doctor assembly according to the invention.

The lower jaw of the blade holder of FIG. 2 is integrated with the rotating frame component, the blade holder comprising a simple retaining strip 11, for locking doctor blade 10 in place.

If necessary, liquid-lubrication is arranged in the jointed bearing assembly, for example water flushing for diminishing the friction.

Figure 3:
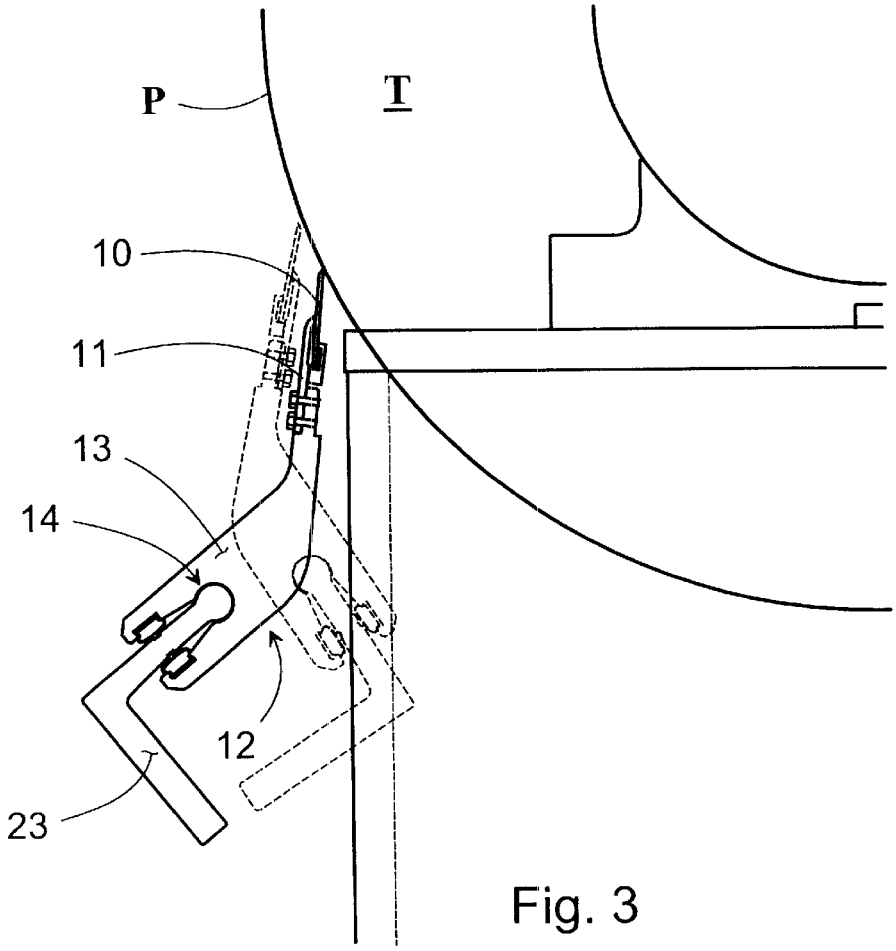
FIG. 3 shows ways of installing a doctor assembly according to the invention in a paper machine.

The doctor assemblies according to FIGS. 1 and 2 can be installed, according to FIG. 3, in two alternative ways depending on the space available, by only moving the blade holder to the opposite side of the holder frame. Frame component 23 can be attached to the paper machine structure at the location of the doctor in a relatively unrestricted manner. Because the doctor assembly is quite light, the loading on the frame is much less than previously.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

Figure 4:
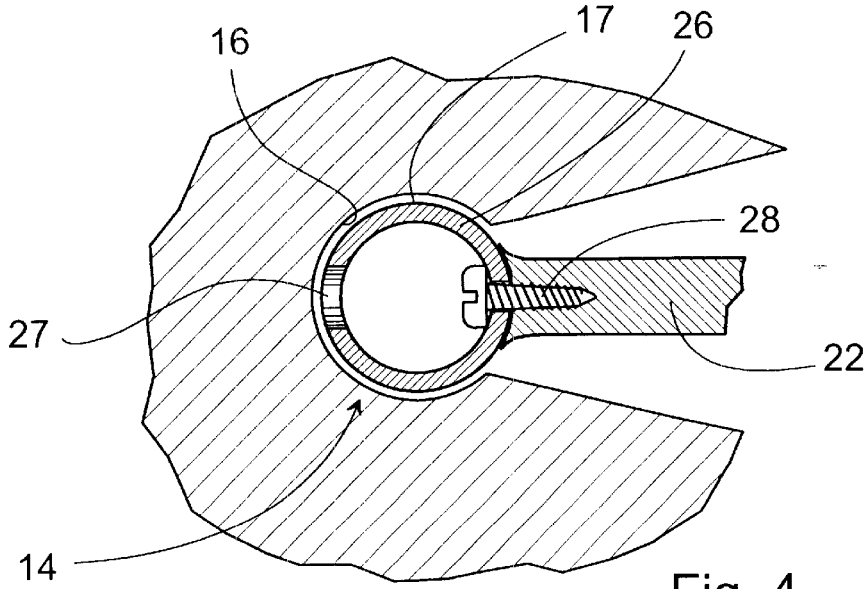
FIG. 4 shows one embodiment of the joint axle of a doctor assembly according to the invention.

According to FIG. 4, jointed bearing assembly 14 can be implemented by using a separate tube 26 as the joint axle, the outer surface of which forms the necessary joint pin 17. This tube 26 is secured, e.g., by means of screws 28 to the thin flange area 22. The screws can be fitted to tube 26 through holes 27 formed in tube 26. These holes do not create a problem, as they form an extremely small proportion of the total surface area of the tube, and have nearly no lateral loading. If necessary, lubricating water can be fed to the joint through these holes.

FIGS. 1 and 2 shows clearly that components I and II can be manufactured from a suitable composite material, such as the various fibre-reinforced plastics. The opposing parts of the jointed bearing assembly would be integrated directly in these components.

The doctor according to the invention is also suitable for use with a suction roll, i.e. the solution may be of the foil blade type. In this case, the cleaning of the roll refers mainly to the removal of water.

What is claimed is:

1. A doctor assembly in a paper machine, which is intended to clean a moving surface, and which includes a surface against which a doctor blade is set, a blade support for supporting the doctor blade, a frame, a jointed bearing assembly, which supports the doctor blade and is itself supported from the frame, and which is parallel to the doctor blade, and loading devices between the blade support and the frame for turning the doctor blade in relation to the frame and for pressing the doctor blade against the surface with a selected pressure; characterized in that the jointed bearing assembly between the blade support and the frame consists of an operational joint sleeve fixed to one of these components and a concentric operational joint pin fixed to the opposing component, the joint pin being installed to rotate in the joint sleeve, the joint sleeve and joint pin having mutual bearing surfaces, the jointed bearing assembly being formed in such a way that there is a gap parallel to the joint axis in the joint sleeve set in the first component, and the opposing component includes a thin flange area, which extends through the said gap to its joint pin set in the joint sleeve, so that the joint pin can rotate to a limited extent within the joint sleeve with said gap limiting the degree of rotation of the thin flange area and the related joint pin.

2. A doctor assembly according to claim 1, characterized in that the joint sleeve is installed in the bottom of a structure with a U-shaped cross-section, in the first component.

3. A doctor assembly according to claim 1, characterized in that the loading devices are located on each side of the thin flange area, between claws of the U-shaped structure.

4. A doctor assembly according to claim 2, characterized in that the joint sleeve of the jointed bearing assembly is integrated directly with the first component in such a way that the bottom surface of the U-shaped structure forms the bearing surface.

5. A doctor assembly according to claim 2, characterized in that the joint pin of the jointed bearing assembly is integrated directly with the aforesaid opposing component in such a way that a shape with a cross-section corresponding to that of the axle is formed in the end of the thin flange area.

6. A doctor assembly according to claim 2, characterized in that at least one of the aforesaid components includes an extruded fibre-reinforced piece.

7. A doctor assembly according to claim 1, characterized in that the blade support consists of a blade holder and a holder frame connected to the jointed bearing assembly.

8. A doctor assembly according to claim 1, characterized in that the doctor assembly includes an oscillating device that is connected directly to the blade support.

9. A doctor assembly according to claim 1, characterized in that the frame forms a bearer, by means of which the doctor assembly is attached directly to the supporting structure of the paper machine.

10. A doctor assembly according to claim 1, characterized in that the joint pin of the jointed bearing assembly is formed from a tube attached to the end of the opposing component.

11. A doctor assembly according to claim 1, characterized in that the jointed bearing assembly includes liquid-lubrication devices.

* * * * *